US011761241B2

(12) United States Patent
Zhou et al.

(10) Patent No.: US 11,761,241 B2
(45) Date of Patent: Sep. 19, 2023

(54) ACCIDENTAL UNLOCKING PREVENTION ELECTRONIC LOCK

(71) Applicant: Chengdu Hizima Technology Co., Ltd., Sichuan (CN)

(72) Inventors: Guoquan Zhou, Sichuan (CN); Yong Zhao, Sichuan (CN)

(73) Assignee: Chengdu Hizima Technology Co., Ltd., Sichuan (CN)

( * ) Notice: Subject to any disclaimer, the term of this patent is extended or adjusted under 35 U.S.C. 154(b) by 181 days.

(21) Appl. No.: 16/652,242

(22) PCT Filed: Jun. 11, 2019

(86) PCT No.: PCT/CN2019/090759
§ 371 (c)(1),
(2) Date: Mar. 30, 2020

(87) PCT Pub. No.: WO2020/019889
PCT Pub. Date: Jan. 30, 2020

(65) Prior Publication Data

US 2021/0131142 A1 May 6, 2021

(30) Foreign Application Priority Data

Jul. 24, 2018 (CN) ..... 201810819965.1

(51) Int. Cl.
*E05B 47/00* (2006.01)
*E05B 47/06* (2006.01)
*E05B 11/00* (2006.01)

(52) U.S. Cl.
CPC ..... *E05B 47/0012* (2013.01); *E05B 11/00* (2013.01); *E05B 47/0611* (2013.01);
(Continued)

(58) Field of Classification Search
CPC ..... E05B 2047/002; E05B 2047/0024; E05B 2047/0026; E05B 2047/0084;
(Continued)

(56) References Cited

U.S. PATENT DOCUMENTS

2018/0051480 A1 2/2018 Tagtow et al.
2018/0155958 A1* 6/2018 Li ..... E05B 17/186
2018/0323632 A1* 11/2018 Astarabadi ..... E05B 47/0012

FOREIGN PATENT DOCUMENTS

CN 206309149 7/2017
CN 206309149 U * 7/2017
(Continued)

OTHER PUBLICATIONS

Annotated machine translation of CN-206309149-U (Year: 2017).*
(Continued)

*Primary Examiner* — Christine M Mills
*Assistant Examiner* — Peter H Watson
(74) *Attorney, Agent, or Firm* — Caesar Rivise, PC

(57) ABSTRACT

The invention discloses an accidental unlocking prevention electronic lock, in particular an accidental unlocking prevention electronic lock in the field of electronic locks. The accidental unlocking prevention electronic lock of the invention comprises a lock cylinder, a control circuit and a clutch sleeve, wherein the control circuit and a key hole are installed in the lock cylinder, and further comprises a transmission system, a power shaft, a clutch cam, a key cam, a key pin and a suspension, wherein the lock cylinder is internally provided with a clamping jaw, a torsion spring and a clamping jaw motor; one end of the clamping jaw is connected with an output shaft of the clamping jaw motor, one end of the torsion spring is fixed in the suspension and the other end thereof is connected with the clamping jaw; the key cam is provided with a limiting groove and the lock
(Continued)

E – E cylinder is provided with a limiting pin. The invention has the advantages of high safety and reliability, low power consumption, small volume and strong impact-resistant performance, and can be protected from accidental unlocking even under the conditions of high-speed impact and severe vibration.

8 Claims, 9 Drawing Sheets

(52) U.S. Cl.
CPC . *E05B 2047/002* (2013.01); *E05B 2047/0024* (2013.01); *E05B 2047/0026* (2013.01); *E05B 2047/0084* (2013.01); *E05B 2047/0093* (2013.01)

(58) Field of Classification Search
CPC ..... E05B 2047/0085; E05B 2047/0093; E05B 11/00; E05B 47/00; E05B 47/0012; E05B 47/0611
See application file for complete search history.

(56) References Cited

FOREIGN PATENT DOCUMENTS

| | | | |
|---|---|---|---|
| CN | 107100446 | | 8/2017 |
| CN | 206409060 U | * | 8/2017 |
| CN | 107119999 A | * | 9/2017 |
| CN | 207110694 | | 3/2018 |
| CN | 108678561 | | 10/2018 |
| GB | 2503502 | | 1/2014 |

OTHER PUBLICATIONS

Annotated machine translation of CN-107119999-A (Year: 2017).*
Annotated machine translation of CN-206409060-U (Year: 2017).*
International Search Report for related PCT Application No. PCT/CN2019/090759 dated Sep. 5, 2019.
English abstract of CN107100446.
English abstract of CN108678561.
English abstract of CN206309149.
Inglish abstract of CN207110694.

* cited by examiner

ACCIDENTAL UNLOCKING PREVENTION ELECTRONIC LOCK

CROSS REFERENCE TO RELATED APPLICATIONS

This application is a U.S. National Phase Application of PCT/CN2019/090759, filed Jun. 11, 2019, which claims priority from China Patent Application No. 201810819965.1, filed Jul. 24, 2018, the contents of which applications are incorporated herein by reference in their entireties for all purposes.

FIELD OF THE INVENTION

The invention relates to an accidental unlocking prevention electronic lock, in particular to an accidental unlocking prevention electronic lock in the field of electronic locks.

BACKGROUND OF THE INVENTION

In the field of security technology and prevention, the electronic lock is almost never opened by other keys based on the secret key set by its electronic chip that is paired with the electronic key and the electronic identity authentication method. The circuit board on the lock cylinder can store multiple groups of electronic key numbers and key pairs to realize the function of unlocking by a plurality of keys. The electronic lock allows the addition or deletion of the authority of a certain key to open the lock in an authorized state. Moreover, the electronic key cannot be copied in an unauthorized state, thus reducing the possibility of technical unlocking and improving the convenience of use.

However, a major safety vulnerability is revealed in the prior art; that is, the electronic lock is easy to be violently opened due to its weak impact-resistant performance, and the lock cylinder may be pulled out even in the unlocked state. For this reason, the state-of-art technology adds an idling structure to the electronic lock, which allows the lock cylinder to automatically idle under unauthorized conditions, and thus effectively avoids violent unlocking and further improves the safety of the electronic lock. However, the lock cylinder even with such an electronic lock may rotate under extreme conditions of high-speed impact or severe vibration, resulting in accidental unlocking of the electronic lock.

SUMMARY OF THE INVENTION

The technical problem to be solved by the invention is to provide an accidental unlocking prevention electronic lock with the performance of high safety and reliability, low power consumption, small volume and strong impact-resistant performance which can not be accidentally unlocked even under the condition of high-speed impact and severe vibration.

The accidental unlocking prevention electronic lock for solving the technical problem in the invention comprises a lock cylinder, a control circuit and a clutch sleeve. The control circuit is provided in the lock cylinder, the control circuit can be integrated into a control circuit plate, the lock cylinder is internally provided with a key hole; and further comprises a transmission system, a power shaft, a clutch cam, a key cam and a key pin, wherein the key cam and the clutch cam are respectively installed at two ends of the power shaft, the transmission system comprises a driving device, a driving gear and a transmission gear; the transmission gear is installed on the power shaft; the driving gear is meshed with the transmission gear; a power output end of the driving device is connected with the driving gear and a control signal input end thereof is connected with the control circuit plate; the clutch sleeve is provided with a clutch groove; a clutch is arranged between the clutch groove and the clutch cam; the key pin is sleeved on the key cam; the lock cylinder is internally provided with a clamping jaw, a torsion spring and a clamping jaw motor; the clamping jaw motor is fixed in the lock cylinder; one end of the clamping jaw is connected with an output shaft of the clamping jaw motor; one end of the torsion spring is fixed in the lock cylinder and the other end thereof is connected with the clamping jaw; the key cam is provided with a limiting groove, and the lock cylinder is provided with a limiting pin.

Further, the accidental unlocking prevention electronic lock comprises a suspension, wherein the suspension is arranged in the lock cylinder; the power shaft passes through a hole of the suspension; the driving device and the clamping jaw motor are installed on the suspension; one end of the torsion spring is fixed on the suspension and the other end thereof is connected with the clamping jaw.

Further, the driving device is a drive motor.

Further, multiple pairs of clutch grooves are arranged in the clutch sleeve.

Further, the clutch is a clutch ball.

Further, the accidental unlocking prevention electronic lock comprises an electrode, wherein one end of the electrode is connected with the control circuit and the other end thereof is a key interface.

Further, the outer wall of the electrode is provided with an insulating layer.

Further, the transmission gear is an internal ring gear transmission gear; the driving gear is meshed with the internal ring gear of the transmission gear and the clamping jaw is clamped at the internal ring gear of the transmission gear.

Further, the transmission ratio of the driving gear to the transmission gear is greater than 1.

The beneficial effects of the invention are as follows: based on the electronic lock structure and the transmission mode of the application, both the motor and the circuit board on the lock cylinder have the advantages of short working time, small electric current, extremely low power consumption, environmental protection and energy conservation, and the lock can be reliably switched from the locked state to the unlocked state; further, there is no safety vulnerability that the key cannot be pulled out while the lock cylinder is in the unlocked state. The lock cylinder idling structure in the locked state provides strong accidental unlocking preventing property; at the same time, a lock cylinder transmission mechanism with a braking function realizes the state changeover, and guarantees that the lock cylinder is not accidentally opened under the condition that the lock cylinder is not electrified or opened, regardless of the impact vibration in any direction. Therefore, the overall safety of the electronic lock is greatly improved.

Figure 1:
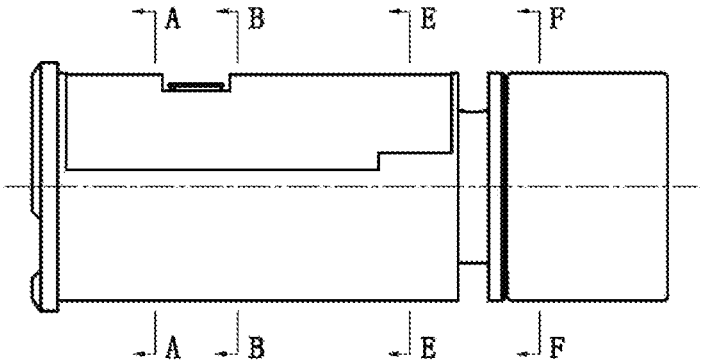
FIG. 1 is a structural diagram of the invention.

Parts, pos. and numbers in the figure: clutch ball 1, transmission gear 2, clamping jaw 3, driving gear 4, drive motor 5, suspension 6, control circuit 7, limiting pin 8, electrode 9, lock cylinder 10, electronic key 11, key pin 12, key cam 13, power shaft 14, screw 15, upper cover 16, clamping jaw motor 17, torsion spring 18, clutch cam 19 and clutch sleeve 20.

DETAILED DESCRIPTION OF THE PREFERRED EMBODIMENT

The invention will be described in detail in combination with drawings.

Figure 2:
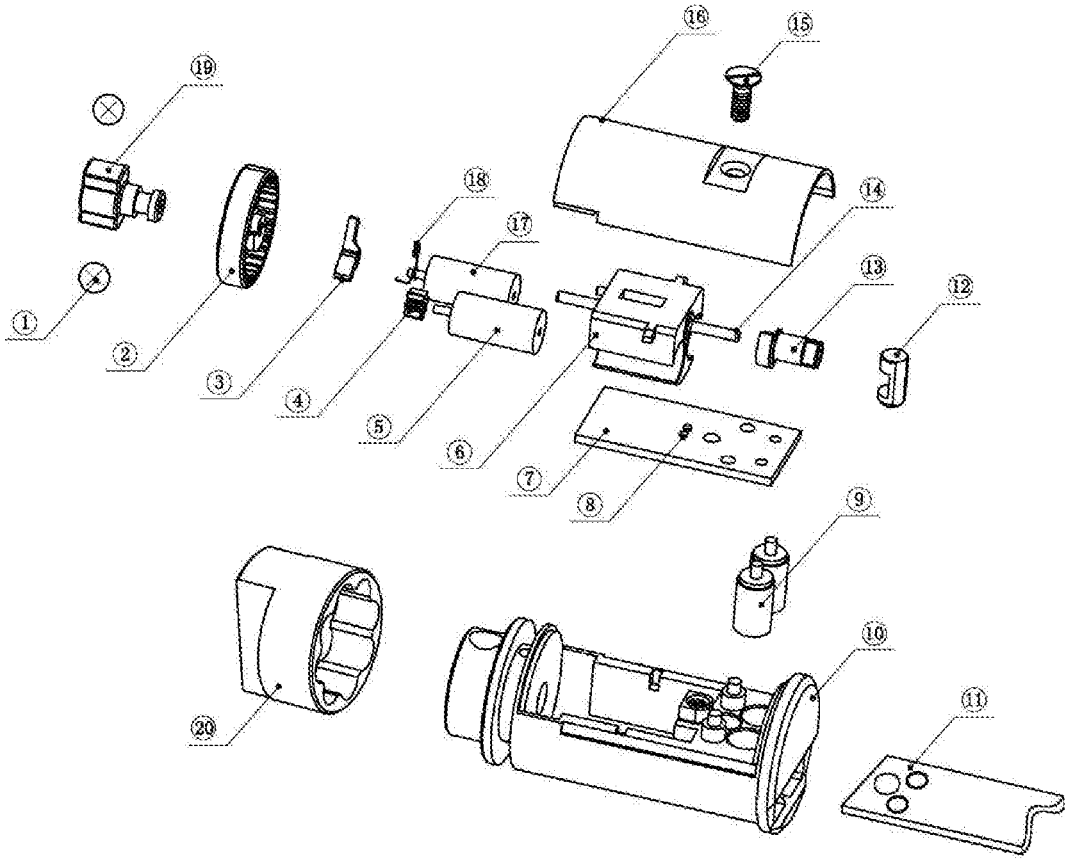
FIG. 2 is an exploded view of the invention.
Figure 5:
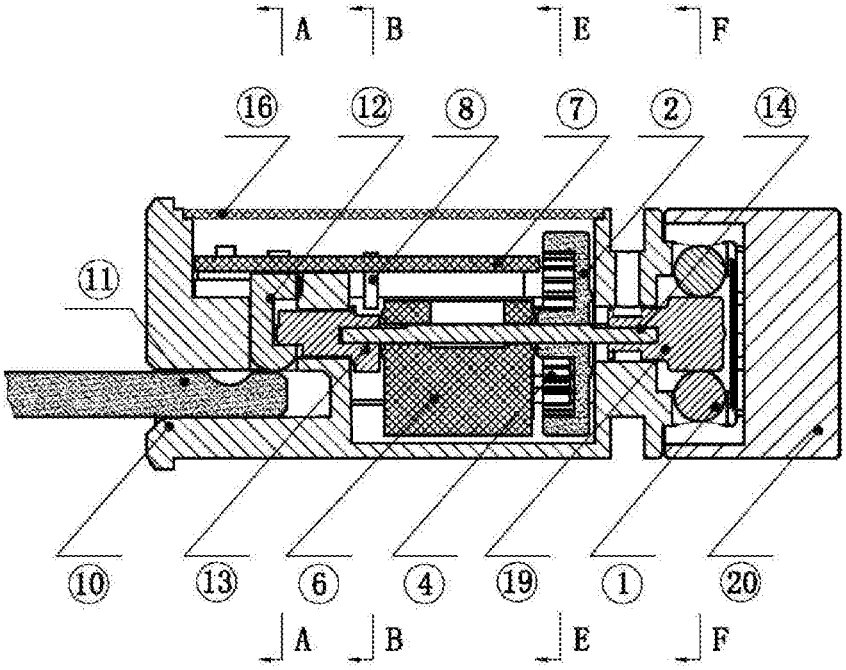
FIG. 5 is a longitudinal sectional view of the invention in the idling state.
Figure 6:
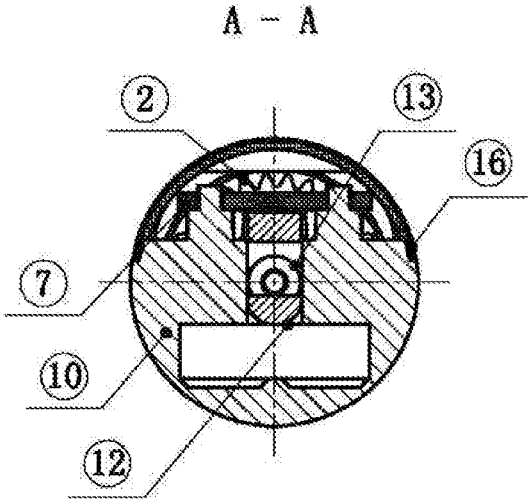
FIG. 6 is an A-A sectional view of the invention in the idling state.
Figure 13:
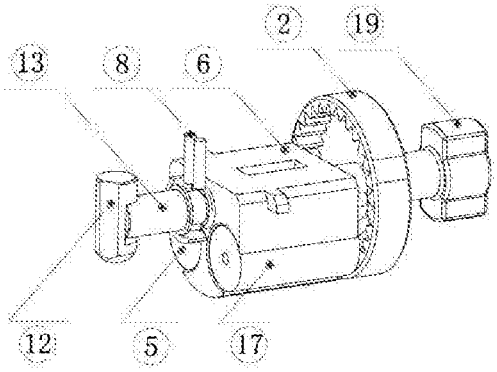
FIG. 13 is a structural diagram of the transmission system of the invention.

As shown in FIG. 1, FIG. 2 and FIG. 5, the accidental unlocking prevention electronic lock of the invention comprises a lock cylinder 10, a control circuit 7 and a clutch sleeve 20, wherein the control circuit 7 is arranged in the lock cylinder 10 and can be integrated into a control circuit plate in specific embodiments, and a key hole is arranged in the lock cylinder 10. Further, the accidental unlocking prevention electronic lock comprises a transmission system, a power shaft 14, a clutch cam 19, a key cam 13 and a key pin 12, wherein the key cam 13 and the clutch cam 19 are respectively installed at two ends of the power shaft 14, the transmission system comprises a driving device, a driving gear 4 and a transmission gear 2; the transmission gear 2 is installed on the power shaft 14; the driving gear 4 is meshed with the transmission gear 2; a power output end of the driving device is connected with the driving gear 4 and a control signal input end thereof is connected with the control circuit 7—plate; the clutch sleeve 20 is provided with a clutch groove; a clutch is arranged between the clutch groove and the clutch cam 19; the key pin 12 is sleeved on the key cam 13; the lock cylinder 10 is internally provided with a clamping jaw 3, a torsion spring 18 and a clamping jaw motor 17; the clamping jaw motor 17 is arranged on the suspension 6, one end of the clamping jaw 3 is connected with an output shaft of the clamping jaw motor 17; one end of the torsion spring 18 is fixed in the suspension 6 and the other end thereof is connected with the clamping jaw 3; the key cam 13 is provided with a limiting groove; the lock cylinder 10 is provided with a limiting pin 8 and the limiting pin 8 is relatively positioned against the lock cylinder 10. The drive mode of the driving device can be electromagnetic driving, hydraulic driving and pneumatic driving. The driving device of the application preferably adopts a drive motor 5, which can adapt to small and compact structure of the electronic lock of the application and reduce the energy consumption while use. The clamping jaw motor 17 can be a compact rotating motor. In the application, the clutch cam 19, the transmission gear 2, and the key cam 13 are all axially sleeved and fixed on the power shaft 14 and synchronously rotate around the power shaft 14 (as shown in FIG. 13), and their radial positions have definite synchronous relationship. In specific embodiments, the clutch cam 19 and the key cam 13 are supported on the shaft hole in the lock cylinder 10 and can rotate around the center of the shaft hole (as shown in FIG. 5).

Figure 14:
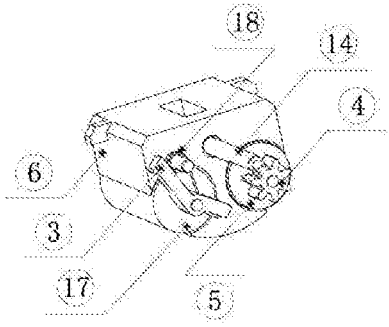
FIG. 14 is a structural diagram of the suspension of the invention.

In this application, the driving device and the clamping jaw motor 17 can be directly installed in the lock cylinder 10, or can be installed on the suspension 6 to keep a fixed position relative to the lock cylinder 10. In specific embodiments, the driving device and the clamping jaw motor 17 can be jointly fixed on the suspension 6, which passes through and rotate around the power shaft 14 (as shown in FIG. 14). Restricted by the inner cavity of the lock cylinder 10, within a small scope, the suspension 6 can rotate around the power shaft 14 in the cavity of the lock cylinder 10. In the application, the suspension is ingeniously used to maintain the clamping jaw motor 17, the torsion spring 18 and the lock cylinder 10 in a relatively fixed position and realize the automatic centering control, so as to obviously reduce the assembly difficulty, and solve the problem that the central hole is difficult to form in mechanical processing due to the complicated shape of the lock cylinder.

The output shafts of the driving device and the clamping jaw motor 17 are arranged in parallel with the power shaft 14 and on the circumference with the power shaft 14 as the center of a circle. The driving gear 4 can properly engage with the inner ring gear of the transmission gear 2 for transmission purpose. The clamping jaw 3 and the inner ring gear of the transmission gear 2 form a braking mechanism. The suspension 6 and other parts are installed on an upper cover 16 on the rear cover of the inner cavity of the lock cylinder 10 and fixed with the screw 15.

Figure 12:
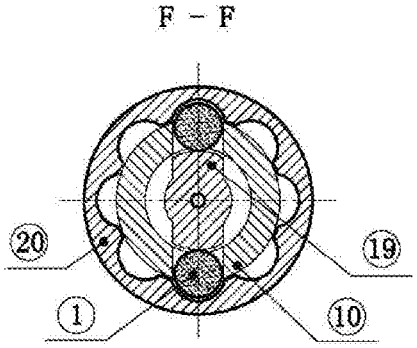
FIG. 12 is an F-F sectional view of the invention in the unlocked state.

The clutch sleeve 20 is sleeved at the end, far from the key hole, of the lock cylinder 10 (as shown in FIG. 1) and can rotate around the axis of the lock cylinder 10. The clutch sleeve 20 is also a lock opener. The lock cylinder 10 can rotate the lock opener, which means the lock can be opened (as shown in FIG. 12).

Figure 3:
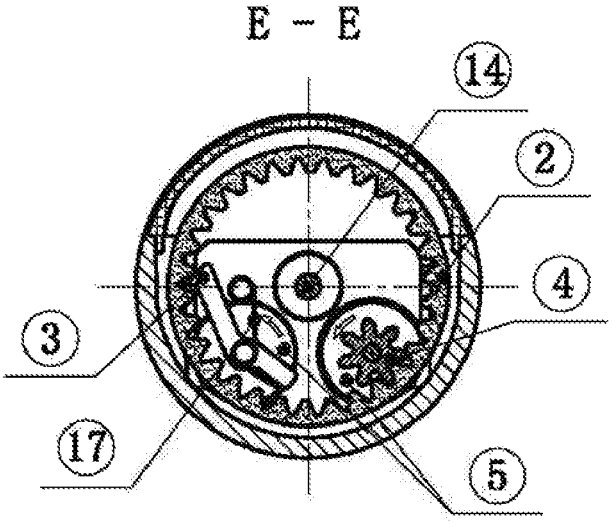
FIG. 3 is a schematic diagram of the braking mechanism of the invention under the condition of braking.
Figure 4:
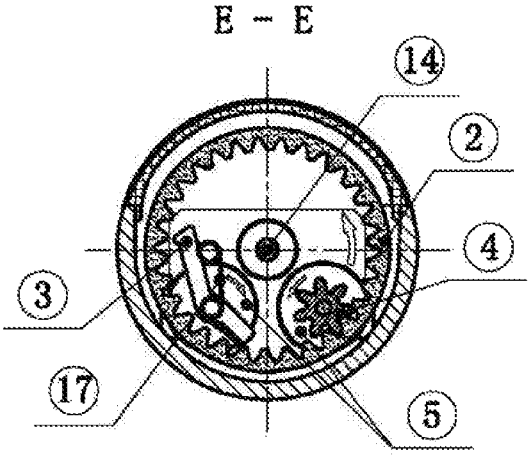
FIG. 4 is a schematic diagram of the braking mechanism of the invention under the condition of un-braking.

When the clamping jaw motor 17 is not energized, the clamping jaw 3 abuts against the tooth surface of the transmission gear 2 with the help of the torsion force of the torsion spring 18. At this time, the transmission gear 2 cannot rotate in unlocking direction, and the unlocking direction is the counterclockwise direction in FIG. 3. When the clamping jaw motor 17 is energized, the clamping jaw 3 releases the tooth surface of the transmission gear 2 against the torsion force of the torsion spring 18, and then the transmission gear 2 can rotate in the unlocking direction (as shown in FIG. 4).

Figure 15:
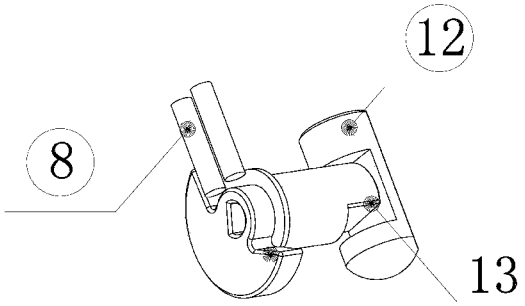
FIG. 15 is a structural diagram of the key cam of the invention.

The electronic lock of the application can be switched between the following two states:

1. Locked state: the lowest radial point of the clutch cam 19 faces toward the clutch and the clutch can be completely retracted into the lock cylinder 10; however, the key cannot rotate the clutch sleeve 20; that is, the lock is in the locked state, i.e. the idling state. The lowest radial point of the key cam 13 (as shown in FIG. 15) faces toward the end, close to the key hole side of the lock cylinder 10, of the key pin 12, which allows the key pin 12 move freely in its cavity. At this time, the electronic key 11 can be freely inserted into or taken out of the key hole, as shown in FIG. 5, FIG. 6, FIG. 7 and FIG. 8.

Figure 7:
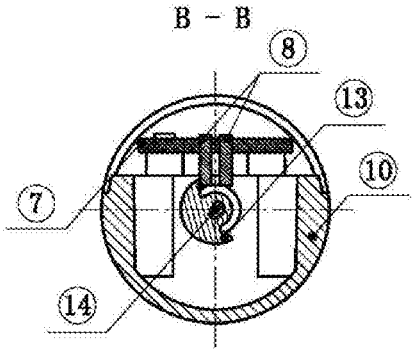
FIG. 7 is a B-B sectional view of the invention in the idling state.
Figure 8:
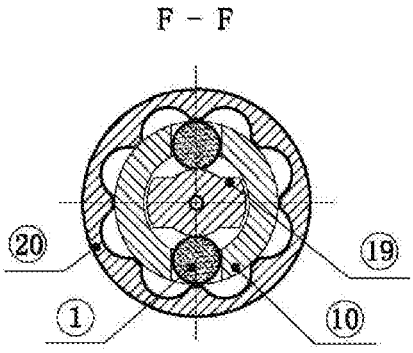
FIG. 8 is an F-F sectional view of the invention in the idling state.
Figure 9:
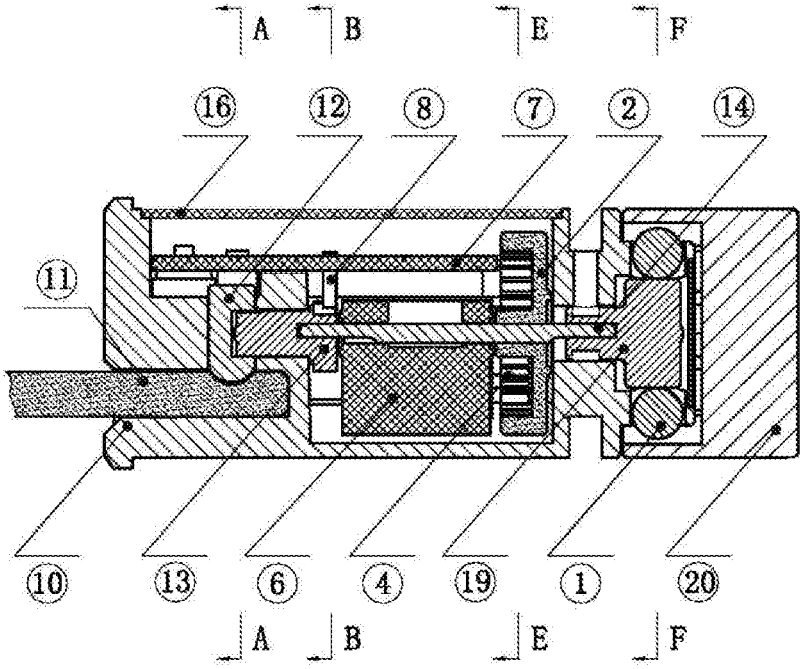
FIG. 9 is a longitudinal sectional view of the invention in the unlocked state.
Figure 10:
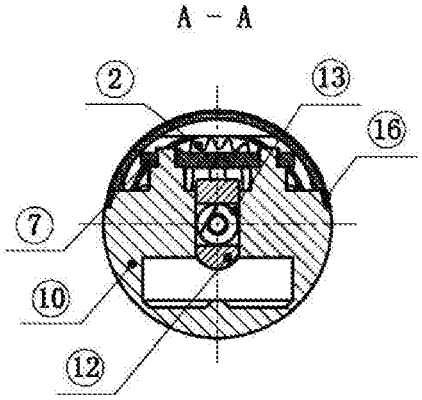
FIG. 10 is an A-A sectional view of the invention in the unlocked state.
Figure 11:
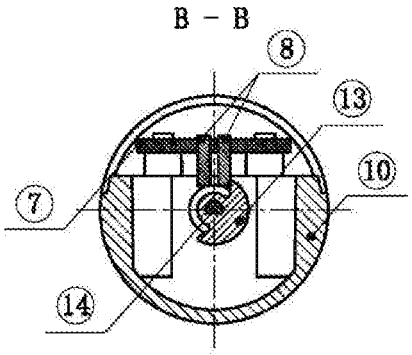
FIG. 11 is a B-B sectional view of the invention in the unlocked state.

Then, as the clamping jaw motor 17 is not energized, the braking mechanism formed by the clamping jaw 3 and the transmission gear 2 is in the locked state, which prevents the transmission gear 2 to rotate counterclockwise (FIG. 3), and the key cam 13 to rotate clockwise due to the limiting pin 8 (FIG. 7). Because the transmission gear 2 is mechanically and axially connected with the key cam 13, the clutch cam 19 and the power shaft 14, and maintains the synchronous phase relation, which means that the transmission gear 2 will not rotate under the action of any impact force.

2. Unlocked state: the highest radial point of the clutch cam 19 faces toward the clutch, of which one part is located in the lock cylinder 10 and the other part is located in the clutch groove of the clutch sleeve 20; as a result, the key can rotate the clutch sleeve 20 and keep the lock in the unlocked state. At this time, the highest radial point of the key cam 13 faces toward one end of the key pin 12 which near the key hole side of the lock cylinder 10, with part of the key pin 12 located in the lock cylinder 10 and the other part in the electronic key 11. Because the key pin 12 is fixed, the electronic key 11 cannot be taken out of the key hole, as shown in FIG. 9, FIG. 10, FIG. 11 and FIG. 12.

In the application, the electronic lock is used as follows:

1. Initial Position: the lock is in the locked state when the electronic key 11 is not inserted into the key hole of the lock cylinder 10.
2. Unlocking: when the authorized electronic key 11 is inserted into the key hole of the lock cylinder 10, the electronic key 11 supplies power and communicates with the control panel through the electrode 9. Until the control panel verifies the legality of the electronic key 11, the clamping jaw motor 17 is energized to rotate, and the braking mechanism releases the rotation restriction on the transmission gear 2. Then, the drive motor 5 rotates forward, and the transmission gear 2 can be driven to rotate in the unlocking direction by the driving gear 4.

When the clutch groove on the clutch sleeve 20 is not aligned with the clutch, the clutch will block the counterclockwise rotational movement of the clutch cam 19. Since the power is still supplied to the drive motor 5 and the clamping jaw motor 17, the clutch and the clutch groove will definitely be aligned at a certain moment when the electronic key 11 rotates the lock cylinder 10.

When the clutch groove on the clutch sleeve 20 is aligned with the clutch, the clutch is partially extended out of the lock cylinder 10 due to the rotating thrust of the clutch cam 19, and the other part is clamped in the clutch groove on the clutch sleeve 20. Now, the lock is in the unlocked state. It is known that the driving gear 2 will stop moving due to the limiting effect of the limiting pin 8 no matter whether the power supply is available, the drive motor 5 and the clamping jaw motor 17 can be powered off for the purpose of saving.

In short, under the above circumstances, rotating the electronic key 11 will eventually drive the lock opener to rotate synchronously; that is, the lock opener will open the unlocking mechanism and keep the lock in the unlocked state.

When the unauthorized electronic key 11 or something else is inserted into the lock, the legitimacy verification fails, the control panel will not start the drive motor 5 and the clamping jaw motor 17, and the electronic lock is still in the locked state.

3. Locking: when the control panel receives a locking command from the key, the clamping jaw motor 17 is energized to rotate, and the braking mechanism releases the rotation restriction of the transmission gear 2. The drive motor 5 rotates in the reverse direction and stops moving due to the limiting effect of the limiting pin 8. Then, the lock is in the locked state, and the electronic key 11 can be pulled out of the key hole on the lock cylinder 10.

Based on the electronic lock structure and the transmission mode of the application, both the motor and circuit board on the lock cylinder have the advantages of short working time, small electric current, extremely low power consumption, environmental protection and energy conservation, and the lock can be reliably switched from the locked state to the unlocked state; that is, when the lock cylinder is in the unlocked state, the key cannot be pulled out, thus solving the safety vulnerability. The idling structure of the lock cylinder in the locked state provides strong accidental unlocking preventing property; at the same time, a lock cylinder transmission mechanism with a braking function realizes the state changeover, and guarantees that the lock cylinder is not accidentally opened under the condition that the lock cylinder is not electrified or opened, regardless of the impact vibration in any direction. Therefore, the overall safety of the electronic lock is greatly improved.

Embodiment 1

In this embodiment, multiple pairs of clutch grooves are arranged in the clutch sleeve 20, which improves the use convenience of the lock with the high probability of the transmission piece entering the clutch groove during unlocking.

Embodiment 2

In this embodiment, the clutch is a clutch ball 1. The clutch ball 1 is structured as a simple ball, and can reduce the energy consumption of the electronic lock and improve the moving reliability of the clutch due to low manufacturing cost and small friction resistance.

Embodiment 3

In this embodiment, the accidental unlocking prevention electronic lock comprises an electrode 9, wherein one end of the electrode 9 is connected with the control circuit 7 and the other end thereof is a key interface. The electronic key 11 supplies power to the circuit board through the electrode 9 as the power supply of the electronic lock, which can effectively avoid the problem that the ordinary electronic lock cannot be unlocked due to battery depletion.

Embodiment 4

In this embodiment, the outer wall of the electrode 9 is provided with an insulating layer. The insulating layer arranged on the cylindrical outer wall of the electrode 9 prevents the electrode 9 from being short-circuited with the lock cylinder 10 after the electrode 9 is installed in the lock cylinder 10.

Embodiment 5

In this embodiment, the transmission ratio of the driving gear 4 to the transmission gear 2 is greater than 1; as a result, the driving gear 4 and the transmission gear 2 form a reducer relationship to amplify the torque of the drive motor 5.

The invention claimed is:

1. An accidental unlocking prevention electronic lock, comprising: a lock cylinder, a control circuit and a clutch sleeve, wherein the control circuit is arranged the lock cylinder, the control circuit is integrated into a control circuit plate, the lock cylinder is internally provided with a key hole, and characterized by further comprising a transmission system, a power shaft, a clutch cam, a key cam and a key pin, wherein the key cam and the clutch cam are respectively installed at two ends of the power shaft; the transmission system comprises a driving device, a driving gear and a transmission gear; the transmission gear is installed on the power shaft; the driving gear is meshed with the transmission gear; a power output end of the driving device is connected with the driving gear; a control signal input end thereof is connected with the control circuit plate; the clutch sleeve is provided with a clutch groove; a clutch is arranged between the clutch groove and the clutch cam; the key in is sleeved on the key cam; the lock cylinder is internally provided with a clamping jaw; a torsion spring, and a clamping jaw motor; the clamping jaw motor is fixed in the lock cylinder; one end of the clamping jaw is connected with an output shaft of the clamping jaw motor; one end of the torsion spring is fixed in the lock cylinder and the other end thereof is connected with the clamping jaw; the key cam is provided with a limiting groove and the lock cylinder is provided with a limiting pin, and characterized by further comprising a suspension, wherein the suspension is arranged in the lock cylinder; the power shaft passes through a hole of the suspension; the driving device and the clamping jaw motor are installed on the suspension; one end of the torsion spring is fixed on the suspension and the other end thereof is connected with the clamping jaw, and further wherein the suspension is configured to rotate around the power shaft in the cavity of the lock cylinder, the output shafts of the driving device and the clamping jaw motor being arranged in parallel with the power shaft and on a circumference with the power shaft as a center of a circle, when the clamping jaw motor is not energized, the clamping jaw abuts against the tooth surface of the transmission gear with the help of a torsion force of the torsion spring, the clamping jaw and the inner ring gear of the transmission gear form a braking mechanism; when the clamping jaw motor is energized, the clamping jaw releases the tooth surface of the transmission gear against the torsion force of the torsion spring, and then the transmission gear is configured to rotate in an unlocking direction.

2. The accidental unlocking prevention electronic lock according to claim 1, characterized in that the driving device is a drive motor.

3. The accidental unlocking prevention electronic lock according to claim 1, characterized in that multiple pairs of clutch grooves are arranged in the clutch sleeve.

4. The accidental unlocking prevention electronic lock according to claim 1, characterized in that the clutch is a clutch ball.

5. The accidental unlocking prevention electronic lock according to claim 1, characterized by further comprising an electrode, wherein one end of the electrode is connected with the control circuit and the other end thereof is a key interface.

6. The accidental unlocking prevention electronic lock according to claim 5, characterized in that the outer wall of the electrode is provided with an insulating layer.

7. The accidental unlocking prevention electronic lock according to claim 1, characterized in that the transmission gear is an internal ring gear transmission gear; the driving gear is meshed with the internal ring gear of the transmission gear and the clamping jaw is clamped at the internal ring gear of the transmission gear.

8. The accidental unlocking prevention electronic lock according to claim 1, characterized in that the transmission ratio of the driving gear to the transmission gear is greater than 1.

* * * * *